US009229418B2

(12) United States Patent
Funayama et al.

(10) Patent No.: US 9,229,418 B2
(45) Date of Patent: Jan. 5, 2016

(54) FRAME STRUCTURE AND IMAGE FORMING APPARATUS INCLUDING SAME

(71) Applicants: Yusuke Funayama, Kanagawa (JP); Hideyuki Takemoto, Kanagawa (JP)

(72) Inventors: Yusuke Funayama, Kanagawa (JP); Hideyuki Takemoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 87 days.

(21) Appl. No.: 13/899,659

(22) Filed: May 22, 2013

(65) Prior Publication Data

US 2013/0330100 A1 Dec. 12, 2013

(30) Foreign Application Priority Data

Jun. 7, 2012 (JP) ..... 2012-130223

(51) Int. Cl.
*G03G 15/00* (2006.01)
*G03G 21/16* (2006.01)

(52) U.S. Cl.
CPC ..... *G03G 21/1619* (2013.01)

(58) Field of Classification Search
CPC ..... G03G 21/1619; G03G 21/1623; G03G 21/1647; G03G 21/1604
USPC ..... 399/107, 111
See application file for complete search history.

(56) References Cited

U.S. PATENT DOCUMENTS

| | | | | |
|---|---|---|---|---|
| 2008/0003015 | A1* | 1/2008 | Tomatsu | G03G 21/1619 399/110 |
| 2009/0218472 | A1* | 9/2009 | Takemoto | 248/542 |
| 2011/0081162 | A1* | 4/2011 | Kawamoto | 399/107 |
| 2012/0219319 | A1 | 8/2012 | Takemoto et al. | |

FOREIGN PATENT DOCUMENTS

| | | |
|---|---|---|
| JP | 61-003559 | 1/1986 |
| JP | 11-334174 | 12/1999 |
| JP | 2001-290322 | 10/2001 |
| JP | 2003-270886 | 9/2003 |
| JP | 2004-029419 | 1/2004 |
| JP | 2004-045923 | 2/2004 |
| JP | 2005-091521 | 4/2005 |
| JP | 2007-334080 | 12/2007 |
| JP | 2010-066735 | 3/2010 |
| JP | 2011-059354 | 3/2011 |

* cited by examiner

*Primary Examiner* — Walter L Lindsay, Jr.
*Assistant Examiner* — Jessica L Eley
(74) *Attorney, Agent, or Firm* — Harness, Dickey & Pierce, P.L.C.

(57) ABSTRACT

A frame structure for use in an image forming apparatus includes a main frame, a front plate to position a first end of a latent image carrier within the image forming apparatus, a rear plate fixed to the main frame to position a second end of the latent image carrier opposite the first end within the image forming apparatus, and a writing device frame fixed to the rear plate to position a latent image writing unit that writes a latent image onto the latent image carrier within the image forming apparatus. The front plate is fixed to the writing device frame. The rear plate is fixed to the main frame at least at three separate positions, at least one position being offset from a hypothetical line connecting the other two positions.

7 Claims, 18 Drawing Sheets

FRAME STRUCTURE AND IMAGE FORMING APPARATUS INCLUDING SAME

CROSS-REFERENCE TO RELATED APPLICATION

This patent application is based on and claims priority pursuant to 35 U.S.C. §119 to Japanese Patent Application No. 2012-130223, filed on Jun. 7, 2012, in the Japan Patent Office, the entire disclosure of which is hereby incorporated by reference herein.

BACKGROUND

1. Technical Field

Exemplary aspects of the present invention generally relate to a frame structure for use in an image forming apparatus and an image forming apparatus including the frame structure.

2. Related Art

Related-art image forming apparatuses, such as copiers, printers, facsimile machines, and multifunction devices having two or more of copying, printing, and facsimile capabilities, typically form a toner image on a recording medium (e.g., a sheet of paper, etc.) according to image data using, for example, an electrophotographic method. In the electrophotographic method, for example, a charger charges a surface of a latent image carrier (e.g., a photoconductor); a writing device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

A tandem-type full-color image forming apparatus includes multiple photoconductors. Light beams are directed from the writing device onto the photoconductors to form latent images on the respective photoconductors. The latent images are developed with toner of different colors so that toner images of the different colors are formed on the respective photoconductors. The toner images thus formed on the photoconductors are then sequentially transferred one atop the other onto a transfer body included in the transfer device to form a single full-color toner image on the transfer body.

In such a configuration, if formed at different positions on the respective photoconductors offset from one another, the latent images are also transferred offset from one another onto the transfer body, causing a so-called color shift in the resultant full-color image. One cause of such offset is unequal distances between the writing device and the respective photoconductors. To accurately position the photoconductors and the writing device relative to one another within the image forming apparatus, front and rear plates, each of which positions the photoconductors, and a writing device frame that positions the writing device need to be accurately fixed in place in the main frame of the image forming apparatus.

There is known a frame structure for use in an image forming apparatus in which first a writing device frame is mounted to the main frame, and then front and rear plates are mounted to the writing device frame. FIG. 1 is a perspective view of a main frame 201 of a related-art image forming apparatus. Multiple stays 201*a*, 201*b*, 201*c*, 201*d*, 201*e*, 201*f*, 201*g*, 201*h*, 201*i*, 201*j*. 201*k*, and 201*l* are assembled together into the main frame 201.

FIG. 2 is a perspective view of the main frame 201 illustrated in FIG. 1, to which a writing device frame 202 is mounted. The rectangular writing device frame 202 is placed on and fixed to the horizontal stays 201*c* and 201*d* of the main frame 201 with screws, so that the writing device is supported by and fixed to the writing device frame 202. Each of a front frame member 202D and a rear frame member 202C of the writing device frame 202 has positioning pins 203 at two separate positions (the positioning pins 203 for the rear frame member 202C are not shown in FIG. 2).

FIG. 3 is a perspective view of the main frame 201 illustrated in FIG. 1, in which front and rear plates 204 and 205 are mounted to the writing device frame 202. The front plate 204 is fitted with the positioning pins 203 of the front frame member 202D to be positioned relative to the writing device frame 202. Then, the front plate 204 is fixed to the writing device frame 202. In a manner similar to the front plate 204, the rear plate 205 is fitted with the positioning pins 203 (not shown) of the rear frame member 202C to be positioned relative to the writing device frame 202. Thereafter, the rear plate 205 is fixed to the writing device frame 202. Each of the front and rear plates 204 and 205 has positioning holes 206 that position photoconductors. The photoconductors, not shown, are fitted with the positioning holes 206 formed in both the front and rear plates 204 and 205, respectively, to be positioned within the image forming apparatus.

In the above-described configuration, the front and rear plates 204 and 205, each of which positions the photoconductors, are directly fixed to the writing device frame 202 that positions the writing device. However, unlike the above-described configuration, in a case in which the front plate 204, the rear plate 205, and the writing device frame 202 are fixed to the main frame 201 individually, tolerances of the main frame 201 accumulate between the rear plate 205 and the writing device frame 202 and between the front plate 204 and the writing device frame 202, respectively. Consequently, the writing device frame 202 and the front plate 204 or the rear plate 205 are not accurately positioned relative to each other.

By contrast, in the above-described configuration, the front plate 204 and the rear plate 205 are directly fixed to the writing device frame 202. As a result, accumulation of tolerances of the main frame 201 is eliminated, thereby achieving accurate relative positioning of the writing device frame 202 and each of the front and rear plates 204 and 205, respectively. Thus, inequality of the distance between the writing device and each photoconductor is prevented, thereby preventing color shift in resultant images. However, because the main frame 201 is constructed of the multiple stays 201*a* to 201*l* assembled together, a force exerted on the main frame 201 in a direction perpendicular to the rear plate 205, that is, a direction indicated by arrow F in FIG. 3, may bend the front stays 201*e* and 201*f* and the rear stays 201*g* and 201*h*, each of which is designed to extend in the vertical direction, resulting in deformation of the main frame 201.

To prevent deformation of the main frame 201, it is conceivable to increase the number of stays assembled together into the main frame 201 and thus improve the strength of the main frame 201. However, the increase in the number of stays also increases production costs and the weight of the frame structure.

SUMMARY

In view of the foregoing, illustrative embodiments of the present invention provide a novel frame structure for use in an image forming apparatus that prevents inequality of a distance between a writing device and each latent image carrier, an increase in a weight of the image forming apparatus, and deformation of the frame structure, all at reduced costs. Illustrative embodiments of the present invention further provide a novel image forming apparatus including the frame structure.

In one illustrative embodiment, a frame structure for use in an image forming apparatus includes a main frame, a front plate to position a first end of a latent image carrier within the image forming apparatus, a rear plate fixed to the main frame to position a second end of the latent image carrier opposite the first end within the image forming apparatus, and a writing device frame fixed to the rear plate to position a latent image writing unit that writes a latent image onto the latent image carrier within the image forming apparatus. The front plate is fixed to the writing device frame. The rear plate is fixed to the main frame at least at three separate positions, at least one position being offset from a hypothetical line connecting the other two positions.

In another illustrative embodiment, an image forming apparatus includes a latent image carrier, a latent image writing unit to write a latent image onto the latent image carrier, a developing device to develop the latent image formed on the latent image carrier with developer to form a visual image on the latent image carrier, a transfer device to transfer the visual image from the latent image carrier onto a recording medium, and the frame structure for use in the image forming apparatus described above.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
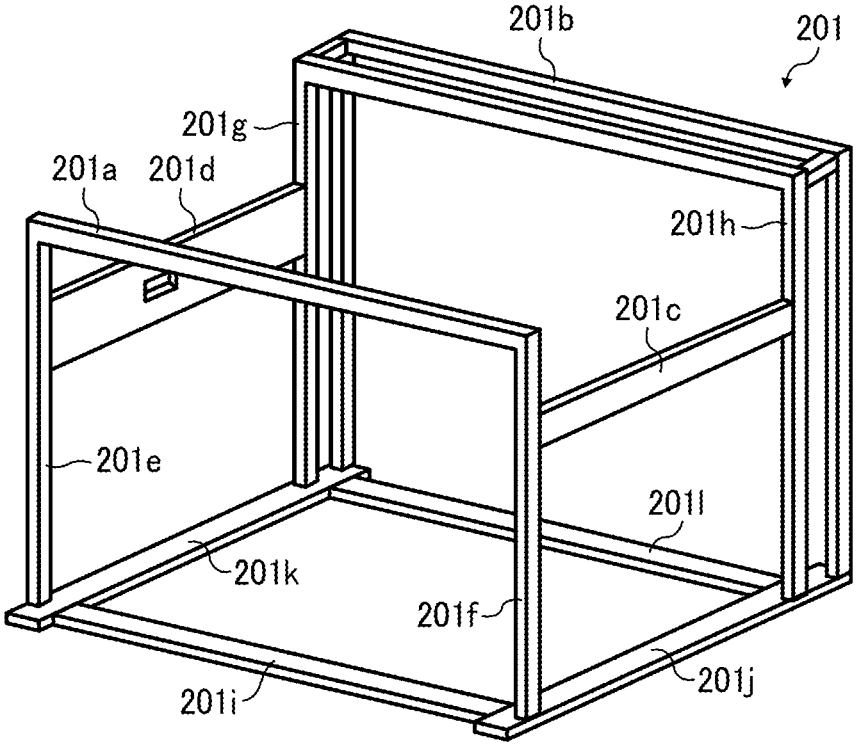
FIG. 1 RELATED ART
FIG. 1 is a perspective view of a main frame of a related-art image forming apparatus.
Figure 2:
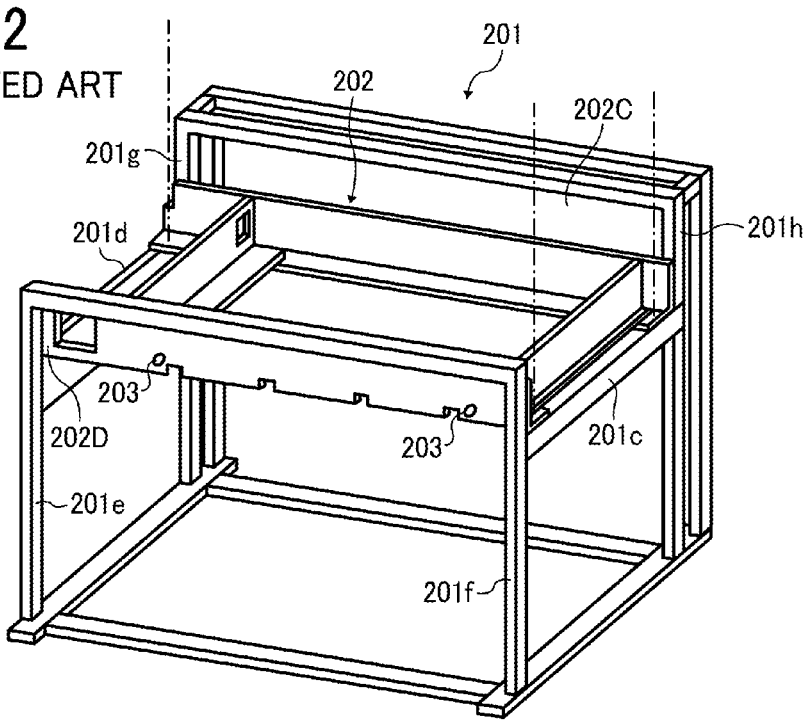
FIG. 2 RELATED ART
FIG. 2 is a perspective view of the main frame illustrated in FIG. 1, to which a writing device frame is mounted.
Figure 3:
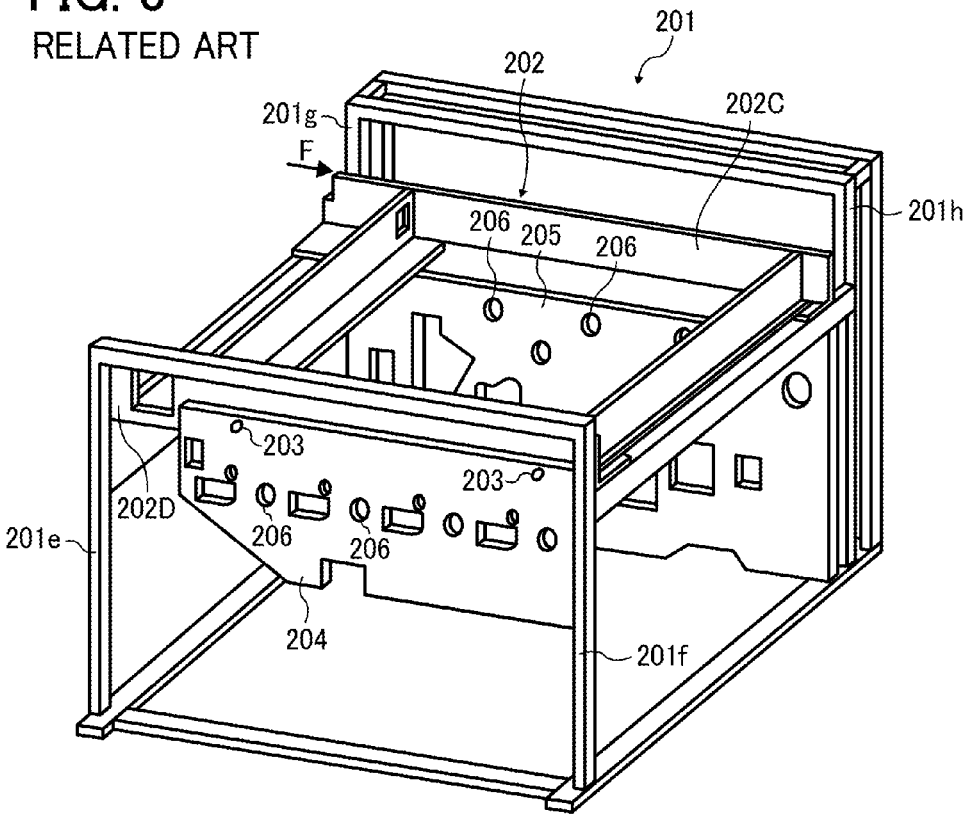
FIG. 3 RELATED ART
FIG. 3 is a perspective view of the main frame illustrated in FIG. 1, in which front and rear plates are mounted to the writing device frame.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

Figure 4:
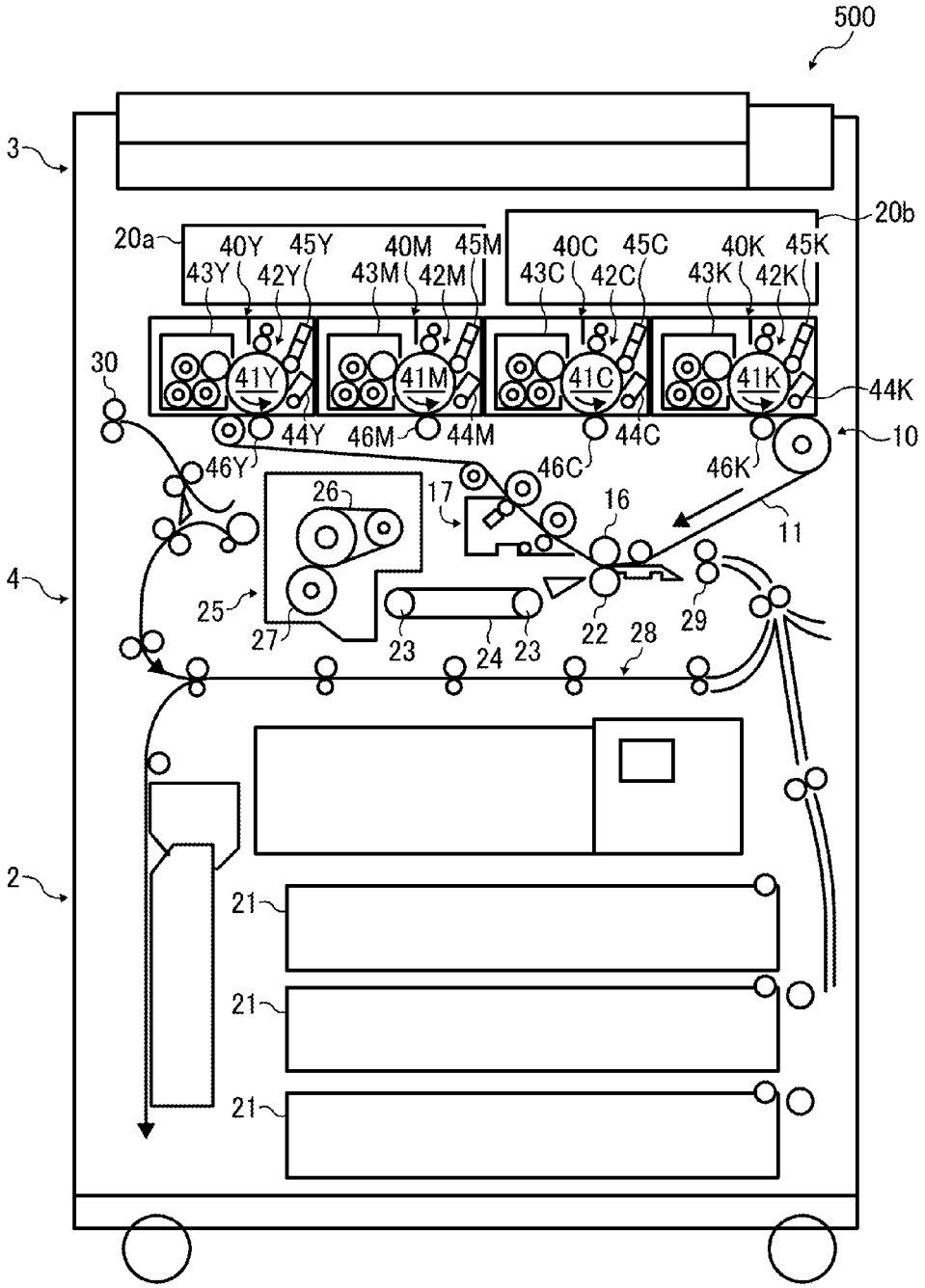
FIG. 4 is a vertical cross-sectional view illustrating an example of a configuration of an image forming apparatus according to an illustrative embodiment.

A description is now given of a configuration and operation of an image forming apparatus 500 according to an illustrative embodiment, with reference to FIG. 4. FIG. 4 is a vertical cross-sectional view illustrating an example of a configuration of the image forming apparatus 500 according to the illustrative embodiment.

The image forming apparatus 500 functions as a digital full-color copier in which an image of a document read by scanning the document is digitized to form the image on a recording medium such as a sheet of paper. In addition, the image forming apparatus 500 also functions as a facsimile machine that sends and receives image data of a document to and from remote locations, and as a printer that prints image data sent from a personal computer on a sheet.

The image forming apparatus 500 is a tandem-type full-color electrophotographic device employing an intermediate transfer system. The image forming apparatus 500 includes a sheet feeding unit 2, an image forming unit 4 disposed above the sheet feeding unit 2, and a scanner unit 3 disposed above the image forming unit 4. The sheet feeding unit 2 includes multiple sheet feeders, which, in the present illustrative embodiment, are sheet feeding trays 21 disposed one above the other. Each sheet feeding tray 21 accommodates a stack of recording media such as sheets of plain paper.

The image forming unit 4 includes a transfer device 10 including an endless intermediate transfer belt 11. The intermediate transfer belt 11 is rotated in a clockwise direction in FIG. 4. Process cartridges 40Y, 40M, 40C, and 40K (hereinafter collectively referred to as process cartridges 40), each forming a toner image of a specific color, that is, yellow (Y), magenta (M), cyan (C), or black (K), are arranged side by side above the intermediate transfer belt 11 along a direction of rotation of the intermediate transfer belt 11. The process cartridges 40 respectively include latent image carriers, which, in the present illustrative embodiment, are photoconductors 41Y. 41M. 41C, and 41K (hereinafter collectively referred to as photoconductors 41). The photoconductors 41 are rotatable in a counterclockwise direction in FIG. 4, and chargers 42Y, 42M, 42C, and 42K (hereinafter collectively referred to as chargers 42), developing devices 43Y, 43M, 43C, and 43K (hereinafter collectively referred to as developing devices 43), primary transfer devices 46Y, 46M, 46C, and 46K (hereinafter collectively referred to as primary transfer devices 46), cleaning devices 44Y, 44M, 44C, and 44K (hereinafter collectively referred to as cleaning devices 44), and lubricant applicators 45Y, 45M, 45C, and 45K (hereinafter collectively referred to as lubricant applicators 45), are provided around the photoconductors 41, respectively. Latent image writing units, which, in the present illustrative embodiment, are writing units 20*a* and 20*b*, are disposed above the process cartridges 40.

A secondary transfer device 22 is disposed below the intermediate transfer belt 11 and opposite an opposing roller 16 with the intermediate transfer belt 11 interposed therebetween to press against the opposing roller 16 via the intermediate transfer belt 11. As described in detail later, the secondary transfer device 22 secondarily transfers a toner image formed on the intermediate transfer belt 11 onto a sheet conveyed between the secondary transfer device 22 and the intermediate transfer belt 11. A belt cleaning device 17 that removes residual toner from the intermediate transfer belt 11 after the secondary transfer of the toner image from the intermediate transfer belt 11 onto the sheet is provided downstream from the opposing roller 16 in the direction of rotation of the intermediate transfer belt 11. The belt cleaning device 17 includes a lubricant application mechanism that supplies lubricant to the surface of the intermediate transfer belt 11.

A fixing device 25 that fixes the toner image onto the sheet is provided downstream from the secondary transfer device 22 in a direction of conveyance of the sheet. The fixing device 25 includes an endless fixing belt 26 and a pressing roller 27 pressed against the fixing belt 26. The sheet having the secondarily transferred toner image thereon is conveyed to the fixing device 25 by an endless conveyance belt 24 wound around a pair of rollers 23. A reverse unit 28 that reverses the sheet during duplex image formation is provided below the secondary transfer device 22.

During full-color image formation, first, the scanner unit 3 reads an image of a document set on a contact glass, not shown. At the same time, the photoconductors 41 are rotated so that toner images of the specified colors are formed on the photoconductors 41, respectively, by well-known image forming processes. The toner images thus formed on the photoconductors 41 are primarily transferred onto the intermediate transfer belt 11 by the primary transfer devices 46, respectively, and are sequentially superimposed one atop the other on the intermediate transfer belt 11, which is also rotated, so that a single full-color toner image is formed on the intermediate transfer belt 11.

Meanwhile, sheets are fed from one of the sheet feeding trays 21 and separated one by one to be conveyed to a pair of registration rollers 29. The sheet thus conveyed hits against the pair of registration rollers 29, so that conveyance of the sheet is temporarily stopped at the pair of registration rollers 29. Rotation of the pair of registration rollers 29 is started in synchronization with the full-color toner image formed on the intermediate transfer belt 11 to convey the sheet to a secondary transfer position between the intermediate transfer belt 11 and the secondary transfer device 22. Thus, the full-color toner image is secondarily transferred onto the sheet from the intermediate transfer belt 11 by the secondary transfer device 22.

The sheet having the full-color toner image thereon is then conveyed to the fixing device 25. The fixing device 25 fixes the toner image onto the sheet. The sheet having the fixed image thereon is then discharged from the image forming apparatus 500 by a discharge roller 30. In a case of duplex image formation, the sheet having the fixed image thereon is conveyed to the reverse unit 28 to be reversed. The sheet thus reversed is then conveyed to the pair of registration rollers 29. After a skew of the sheet is corrected by hitting against the pair of registration rollers 29, the sheet is conveyed to the secondary transfer position so that a toner image is secondarily transferred onto the back side of the sheet in a manner similar to image formation on the front side of the sheet.

A description is now given of a frame structure 1 for use in the image forming apparatus 500.

Figure 5:
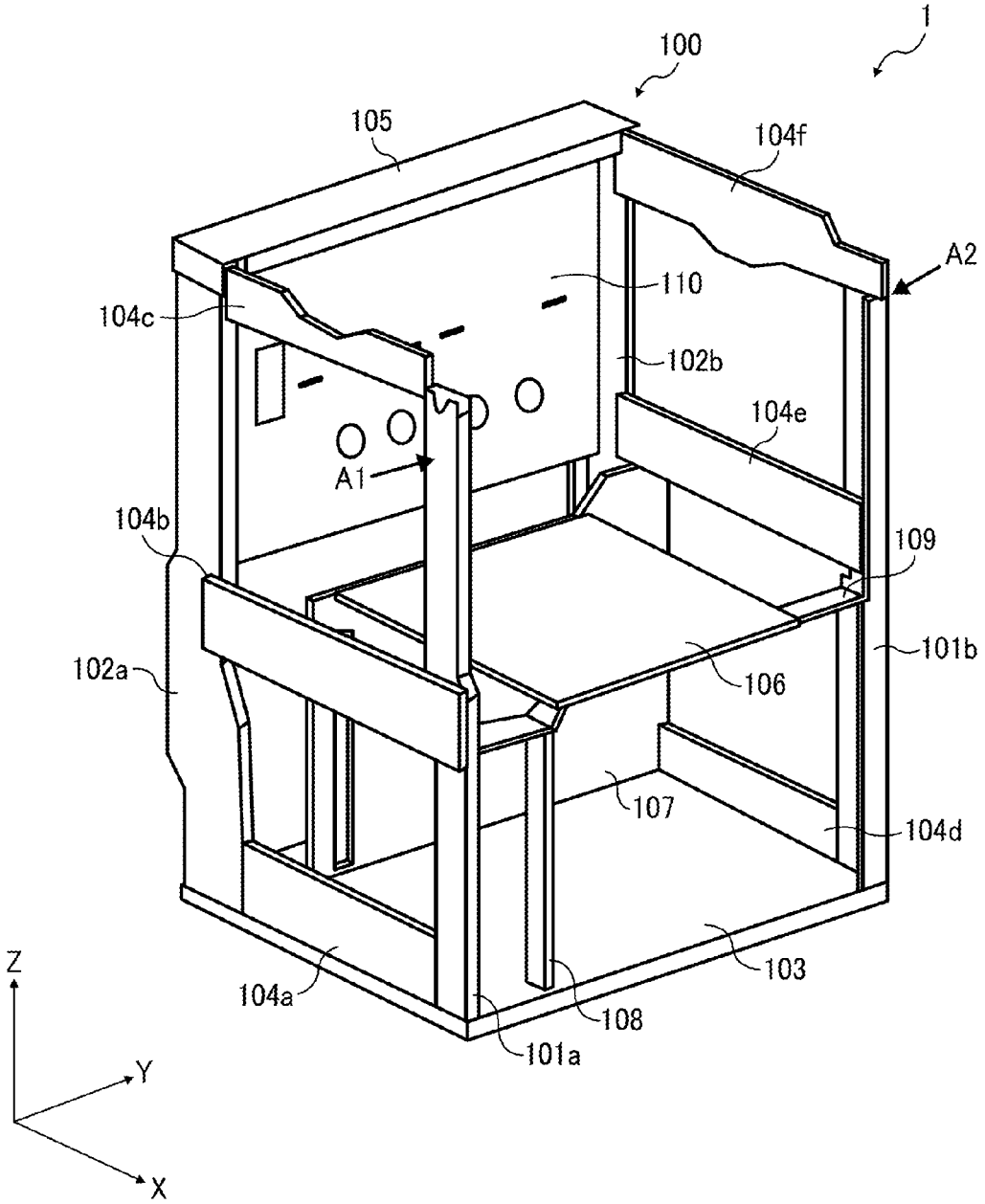
FIG. 5 is a perspective view of a frame structure including a main frame for use in the image forming apparatus.

FIG. 5 is a perspective view of the frame structure 1 including a main frame 100 for use in the image forming apparatus 500.

The main frame 100 is constructed of a bottom plate 103, first and second front posts 101*a* and 101*b*, first and second rear posts 102*a* and 102*b*, a partition plate 106 that separates the sheet feeding unit 2 and the image forming unit 4 from each other, and horizontal stays 104*a*, 104*b*, 104*c*, 104*d*, 104*e*, and 104*f*. Each of the posts 101*a*, 101*b*, 102*a*, and 102*b* extends from each corner of the rectangular bottom plate 103, respectively, in a vertical direction, that is, a Z-axis direction in FIG. 5. The horizontal stays 104*a*, 104*b*, and 104*c* are mounted between the first front post 101*a* and the first rear post 102*a*, both of which are provided at one lateral end in a Y-axis direction in FIG. 5. The horizontal stays 104*d*, 104*e*, and 104*f* are mounted between the second front post 101*b* and the second rear post 102*b*, both of which are provided at the opposite lateral end in the Y-axis direction. An upper rear stay 105 is fixed to the first and second rear posts 102*a* and 102*b* at the top.

A lower rear plate 107 for the sheet feeding unit 2 is mounted on the rear of the bottom plate 103. A support stay 108 that supports the partition plate 106 is also mounted to the bottom plate 103. A mounting stay 109 on which the partition plate 106 is mounted is provided between the first and second front posts 101*a* and 101*b*. Four corners of a rear plate 110 are fixed to the first and second rear posts 102*a* and 102*b* of the main frame 100 with screws, respectively. As a result, the main frame 100 has improved strength, thereby preventing deformation of the main frame 100 even upon application of a force in the Y-axis direction.

Although the four corners of the rear plate 110 are fixed to the main frame 100 with the screws in the above-described example, alternatively, the rear plate 110 may be fixed to the main frame 100 at least at three separate positions, including more than two positions in the Y-axis direction and more than one position offset in the Z-axis direction from a line connecting the more than two positions, thereby improving the strength of the main frame 100 against the force in the Y-axis direction. Further alternatively, holes and protrusions may be provided to the rear plate 110 and the main frame 100, respectively, to fixedly fit the rear plate 110 onto the main frame 100 without using the screws.

Figure 6:
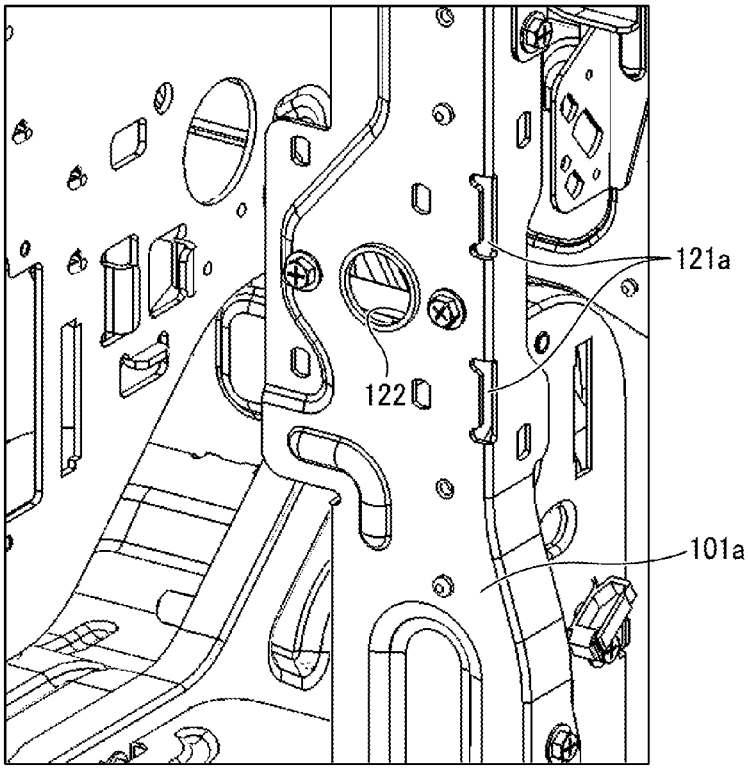
FIG. 6 is a partial enlarged view of a first front post of the main frame viewed from a direction indicated by arrow A1 in FIG. 5.

FIG. 6 is a partial enlarged view of the first front post 101*a* viewed from a direction indicated by arrow A1 in FIG. 5.

Insertion holes, which, in the present illustrative embodiment, are vertical slots 121*a*, into which positioning protrusions 131*a* described later are inserted, respectively, are vertically aligned at two positions on an X-Z plane of the first front post 101*a*. In addition, a mounting hole 122 that engages an adjustment member 140 described later is formed in the X-Z plane of the first front post 101*a*.

Figure 7:
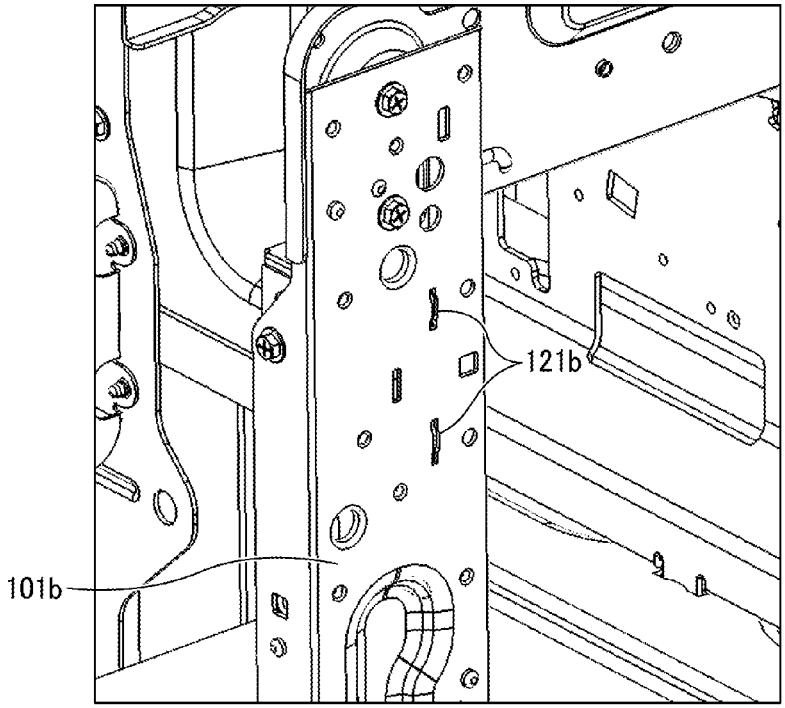
FIG. 7 is a partial enlarged view of a second front post of the main frame viewed from a direction indicated by arrow A2 in FIG. 5.

FIG. 7 is a partial enlarged view of the second front post 101*b* viewed from a direction indicated by arrow A2 in FIG. 5.

Insertion holes, which, in the present illustrative embodiment, are vertical slots 121*b*, into which positioning protrusions 131*b* described later are inserted, respectively, are vertically aligned at two positions on an X-Z plane of the second front post 101*b*.

A vertical length of each slot 121*a* formed in the first front post 101*a* is longer than a vertical length of each slot 121*b* formed in the second front post 101*b*.

Figure 8:
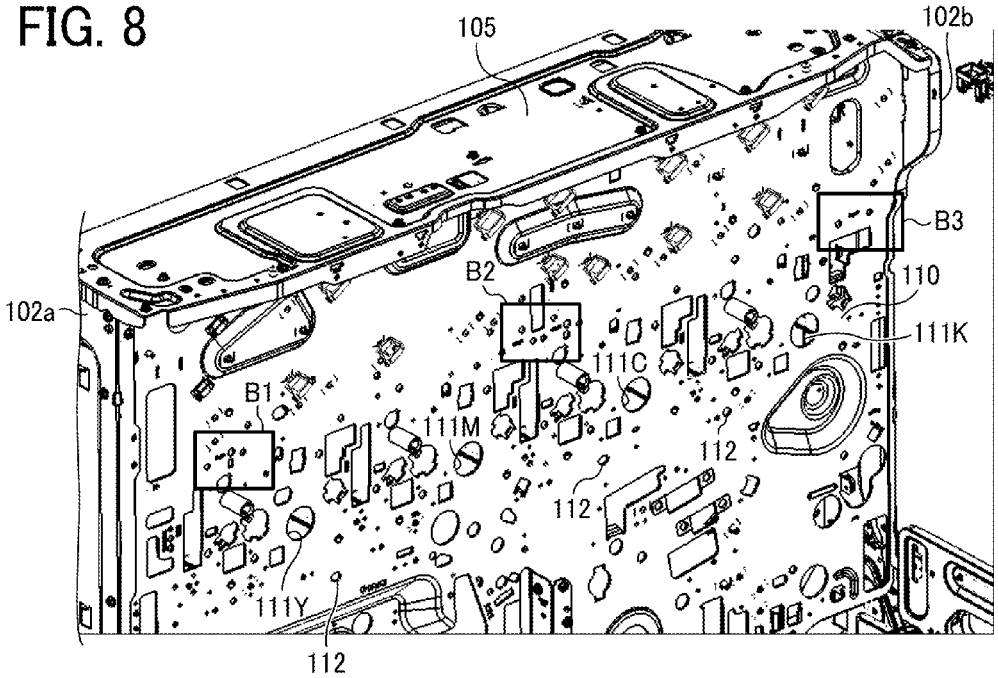
FIG. 8 is a perspective view of a rear plate fixed to the main frame.
Figure 9:
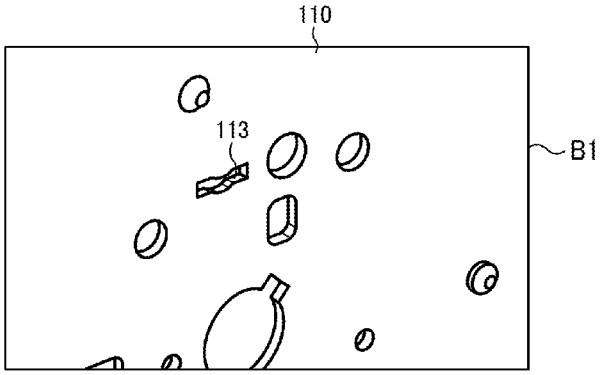
FIG. 9 is an enlarged perspective view of an area B1 illustrated in FIG. 8.
Figure 10:
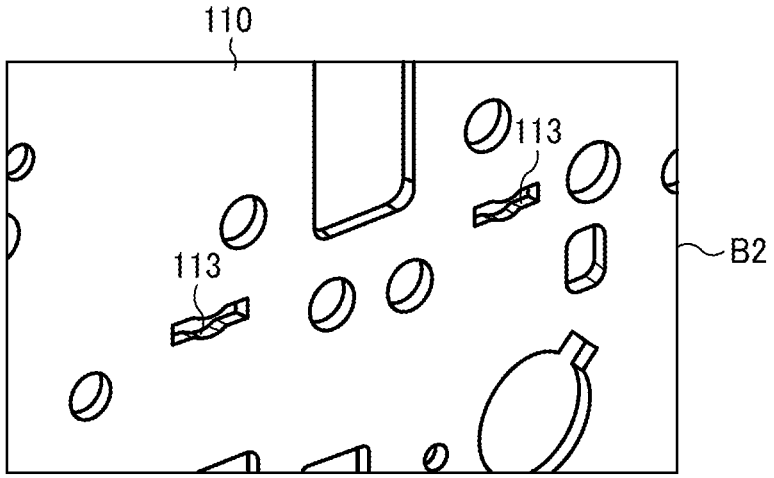
FIG. 10 is an enlarged perspective view of an area B2 illustrated in FIG. 8.
Figure 11:
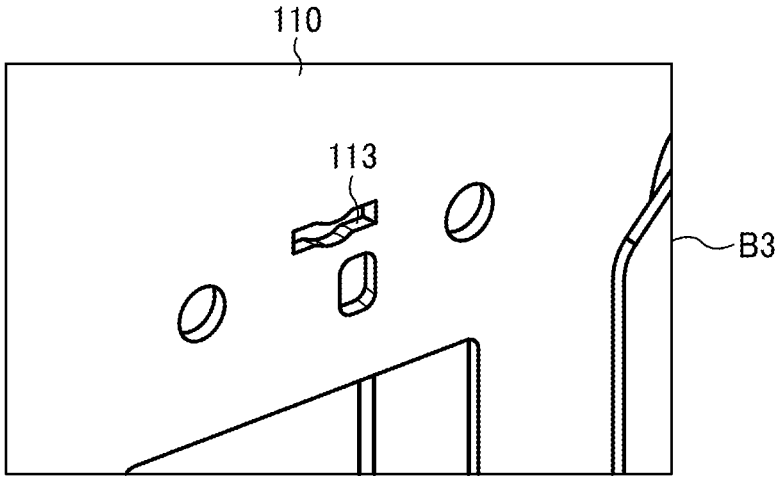
FIG. 11 is an enlarged perspective view of an area B3 illustrated in FIG. 8.

FIG. 8 is a perspective view of the rear plate 110. FIG. 9 is an enlarged perspective view of an area B1 illustrated in FIG. 8. FIG. 10 is an enlarged perspective view of an area B2 illustrated in FIG. 8. FIG. 11 is an enlarged perspective view of an area B3 illustrated in FIG. 8.

Rear positioning holes 111Y, 111M, 111C, and 111K, each positioning the rear end of the photoconductor 41Y, 41M, 41C, or 41K relative to the body of the image forming apparatus 500, are formed in the rear plate 110. In addition, positioning holes 113, each positioning a writing device frame 130 relative to the rear plate 110, are formed in the rear plate 110 at four positions, respectively. Further, positioning holes 112, each positioning the rear of the transfer device 10 relative to the rear plate 110, are formed in the rear plate 110 at three positions, respectively.

Figure 12:
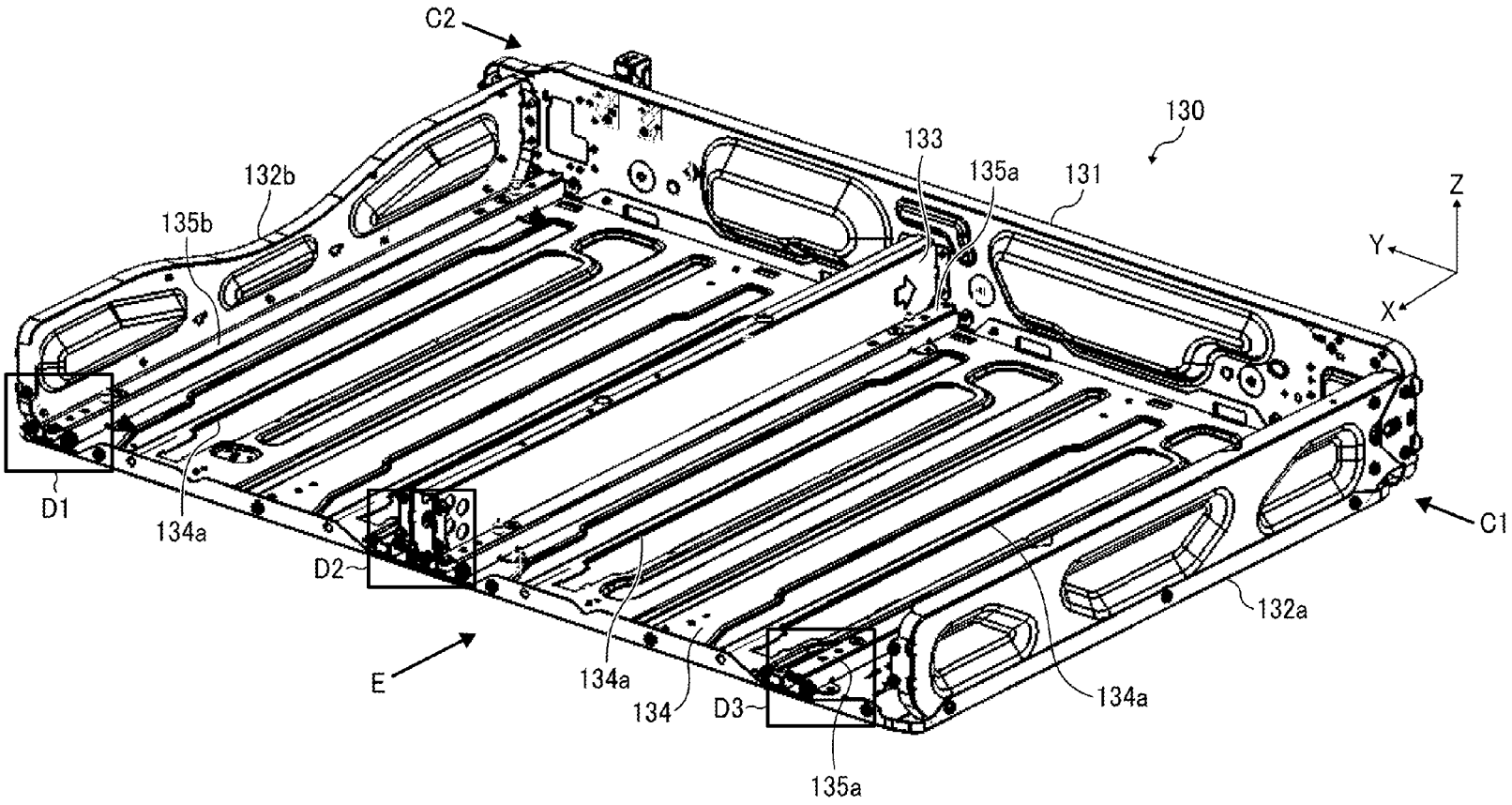
FIG. 12 is a perspective view of a writing device frame.
Figure 13:
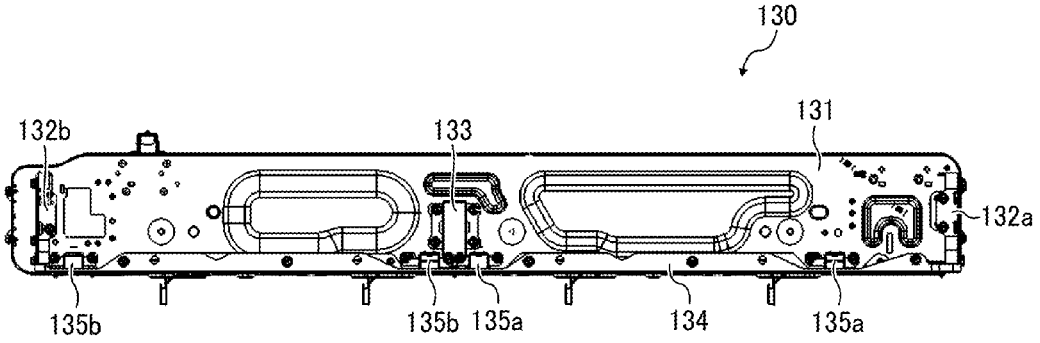
FIG. 13 is a side view of the writing device frame viewed from a direction indicated by arrow E in FIG. 12.

FIG. 12 is a perspective view of the writing device frame 130 that fixedly positions the writing units 20*a* and 20*b* within the image forming apparatus 500. FIG. 13 is a side view of the writing device frame 130 viewed from a direction indicated by arrow E in FIG. 12.

The writing device frame 130 includes a front stay 131, horizontal stays 132*a* and 132*b*, a partition stay 133 that separates the writing units 20*a* and 20*b* from each other, a partition plate 134 that separates the writing units 20*a* and 20*b* from the process cartridges 40, and support stays 135*a* and 135*b* that support the writing units 20*a* and 20*b*, respectively.

Light transmission holes 134*a*, through each of which the light beam emitted from the writing unit 20*a* or 20*b* passes to be directed onto the photoconductor 41Y, 41M, 41C, or 41K, are formed at four positions in the partition plate 134. The front stay 131 is mounted to the front edge of the partition plate 134. The horizontal stays 132*a* and 132*b* are mounted to both ends of the front stay 131 and the partition plate 134 in the Y-axis direction, respectively. The partition stay 133 is fixed to the center of both the partition plate 134 and the front stay 131 in the Y-axis direction. The support stays 135*a* that support the writing unit 20*a* are mounted to the partition plate 134 at two positions, respectively, and the support stays 135*b* that support the writing unit 20*b* are also mounted to the partition plate 134 at two positions, respectively.

Figure 14:
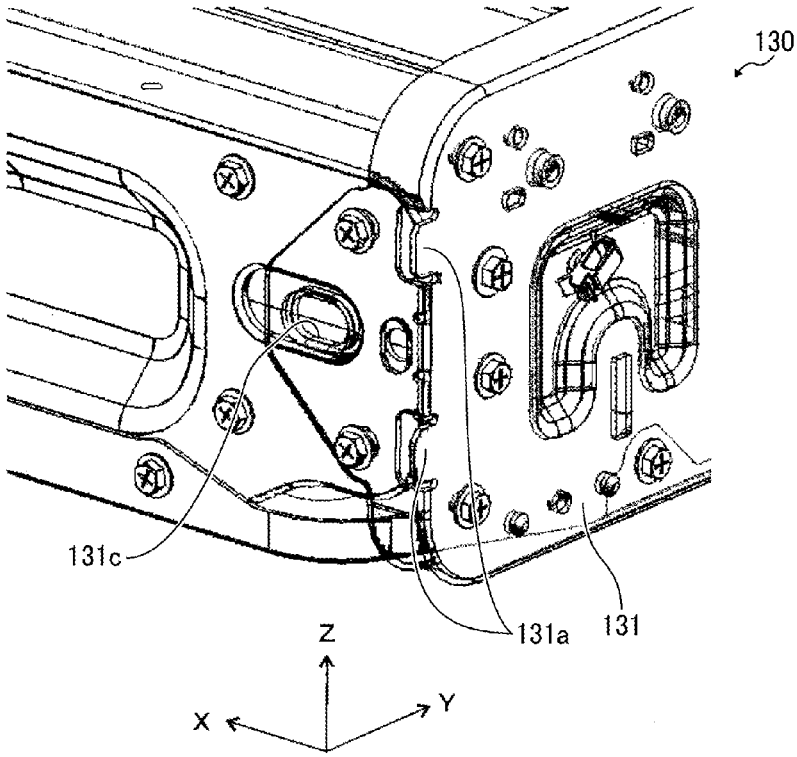
FIG. 14 is a partial perspective view of the writing device frame viewed from a direction indicated by arrow C1 in FIG. 12.

FIG. 14 is a partial perspective view of the writing device frame 130 viewed from a direction indicated by arrow C1 in FIG. 12.

The positioning protrusions 131*a* are provided to one end of the front stay 131 at two positions in the Y-axis direction. In addition, a support hole 131*c*, into which a support protrusion 142 of the adjustment member 140 described later is inserted, is formed in one end of the writing device frame 130. The support hole 131*c* is a slot extending in an X-axis direction.

Figure 15:
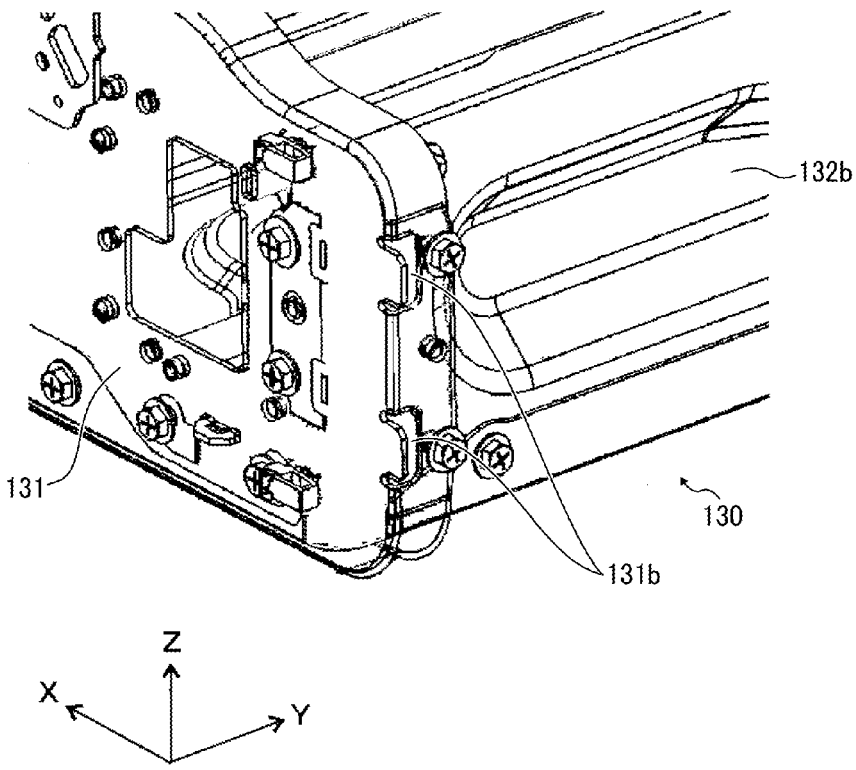
FIG. 15 is a partial perspective view of the writing device frame viewed from a direction indicated by arrow C2 in FIG. 12.

FIG. 15 is a partial perspective view of the writing device frame 130 viewed from a direction indicated by arrow C2 in FIG. 12. The positioning protrusions 131*b* are to the opposite end of the front stay 131 at two positions in the Y-axis direction.

Figure 16:
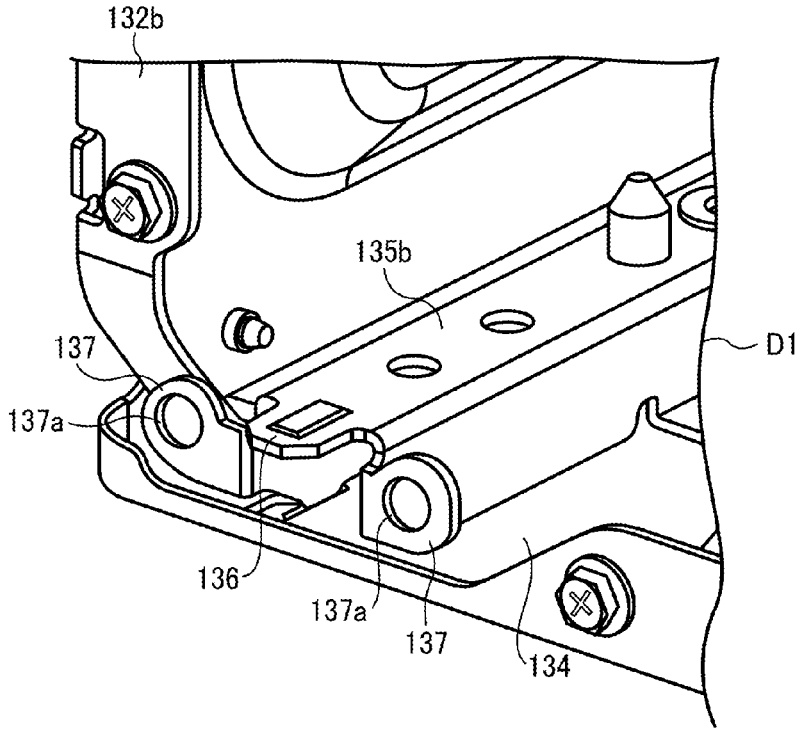
FIG. 16 is an enlarged perspective view of an area D1 illustrated in FIG. 12.
Figure 17:
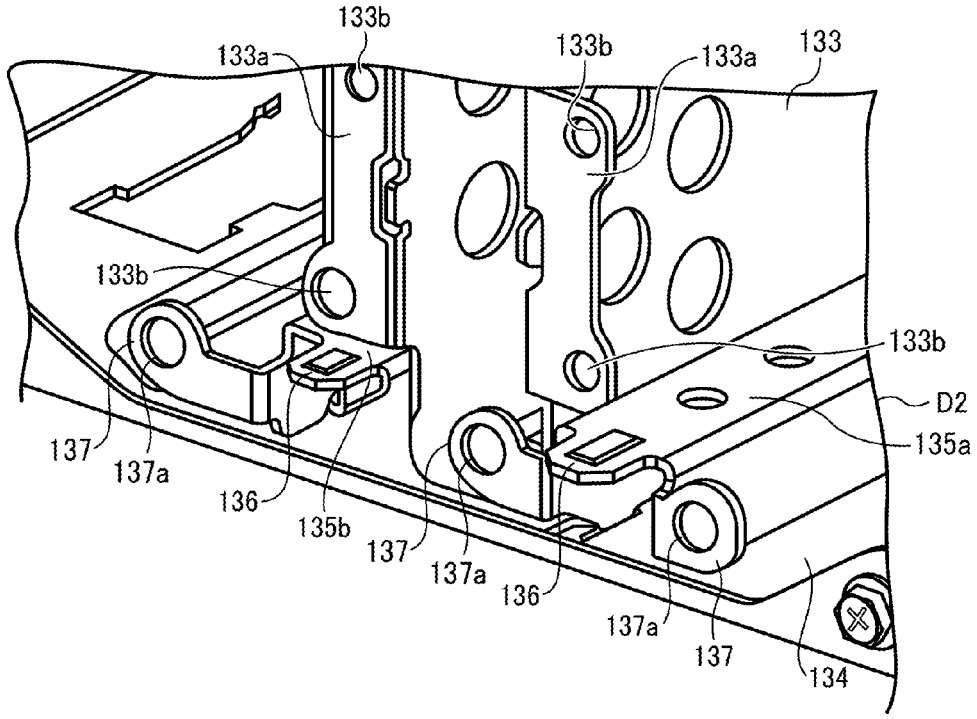
FIG. 17 is an enlarged perspective view of an area D2 illustrated in FIG. 12.
Figure 18:
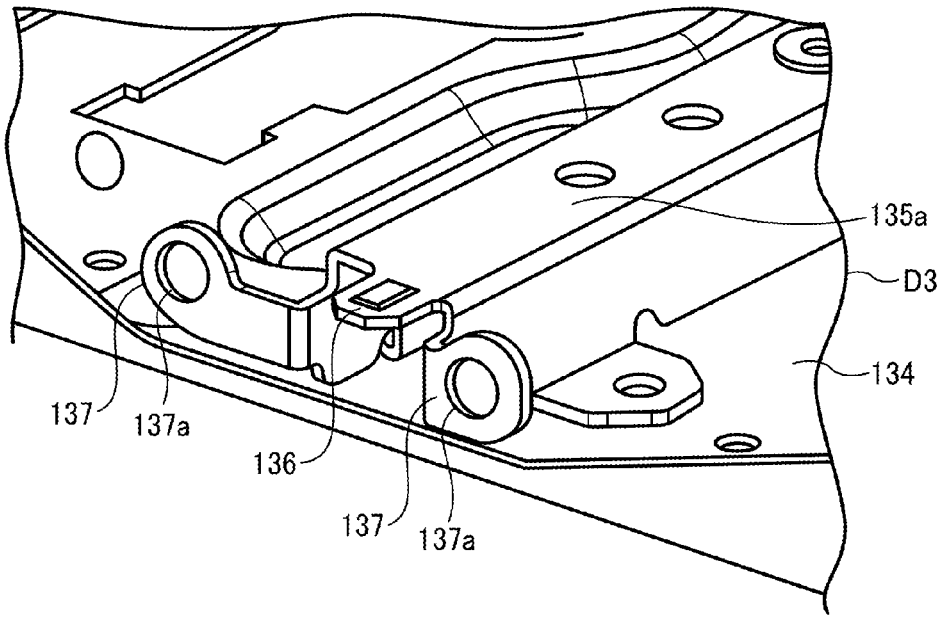
FIG. 18 is an enlarged perspective view of an area D3 illustrated in FIG. 12.

FIG. 16 is an enlarged perspective view of an area D1 illustrated in FIG. 12. FIG. 17 is an enlarged perspective view of an area D2 illustrated in FIG. 12. FIG. 18 is an enlarged perspective view of an area D3 illustrated in FIG. 12.

Each support stay 135*a* and 135*b* has a rear positioning protrusion 136 that positions the support stay 135*a* or 135*b* relative to the rear plate 110. Each support stay 135*a* and 135*b* further has rear mounts 137 each having a hole 137*a*, which is fastened to the rear plate 110 with a screw. As illustrated in FIG. 17, the rear end of the partition stay 133 has rear mounts 133*a*, each having holes 133*b*, each of which is fastened to the rear plate 110 with a screw, respectively.

Figure 19:
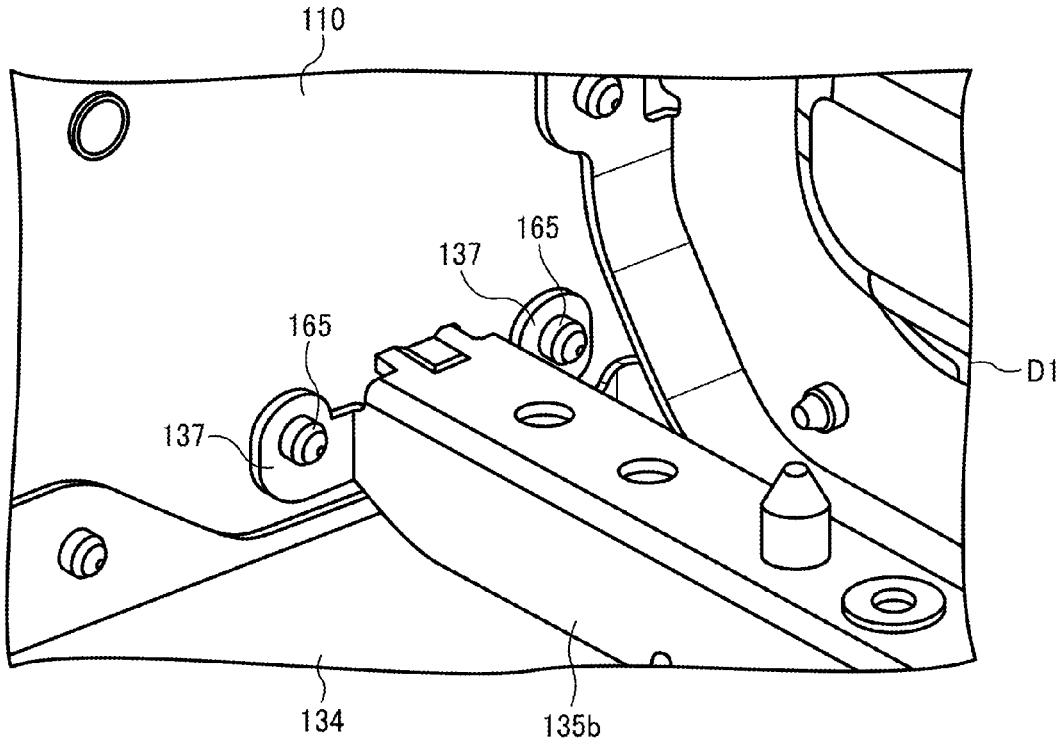
FIG. 19 is an enlarged perspective view of the area D1 illustrated in FIG. 12 in a state in which the writing device frame is fixed to the rear plate.
Figure 20:
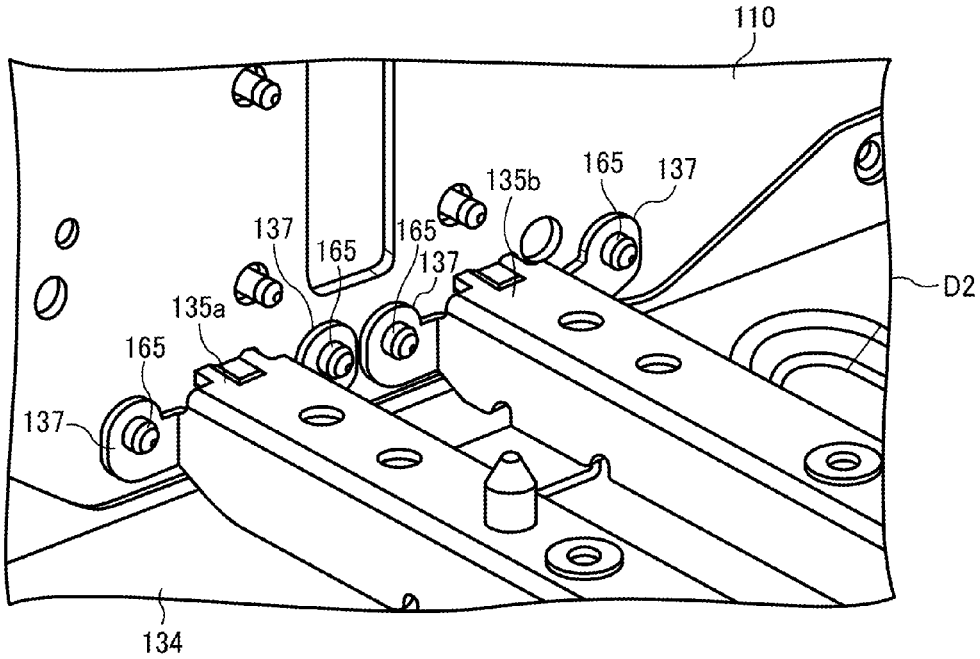
FIG. 20 is an enlarged perspective view of the area D2 illustrated in FIG. 12 in the state in which the writing device frame is fixed to the rear plate.
Figure 21:
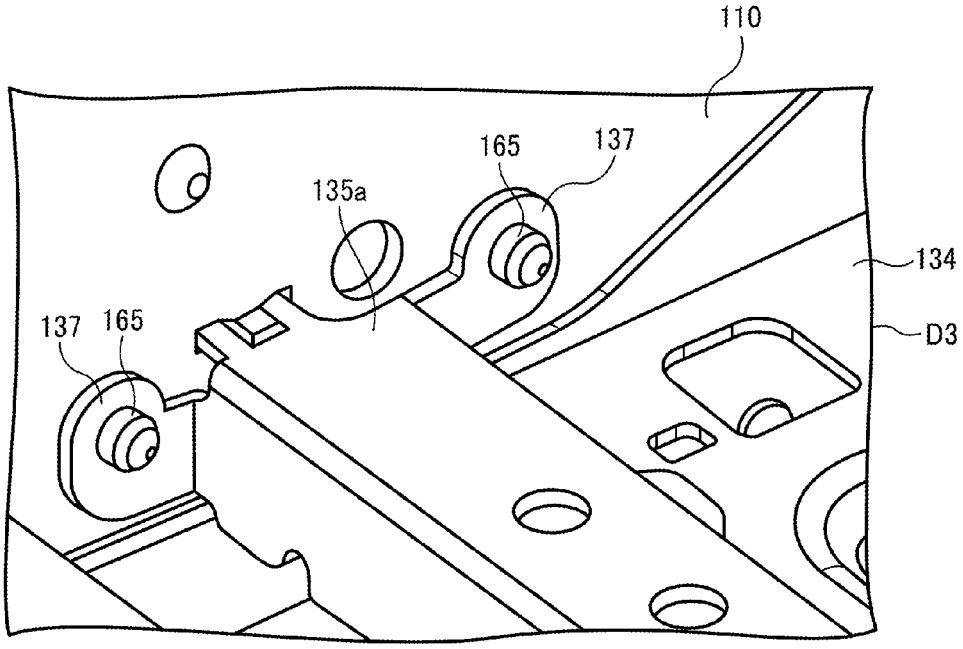
FIG. 21 is an enlarged perspective view of the area D3 illustrated in FIG. 12 in the state in which the writing device frame is fixed to the rear plate.

A description is now given of mounting of the writing device frame 130 to the main frame 100, with reference to FIGS. 19 to 21. FIGS. 19, 20, and 21 are enlarged perspective views of the areas D1, D2, and D3 illustrated in FIG. 12, respectively, in a state in which the writing device frame 130 is fixed to the rear plate 110.

First, the rear positioning protrusions 136 of the support stays 135*a* and 135*b* are inserted into the positioning holes 113 formed in the rear plate 110, respectively. Accordingly, the writing device frame 130 is positioned relative to the rear plate 110. Next, screws 165 are inserted and fastened into the holes 137*a* of the rear mounts 137 of the support stays 135*a* and 135*b*, respectively, so that the support stays 135*a* and 135*b* are fixed to the rear plate 110 as illustrated in FIGS. 19 to 21. It is to be noted that, for ease of illustration, the partition stay 133 is omitted in FIG. 20.

Screws are inserted and fastened into the holes 133*b* formed in the rear mounts 133*a* of the partition stay 133, so that the partition stay 133 is fixed to the rear plate 110. In addition, the rear end of each of the horizontal stays 132*a* and 132*b* and the rear edge of the partition plate 134 are fixed to the rear plate 110 with screws, respectively.

Figure 22:
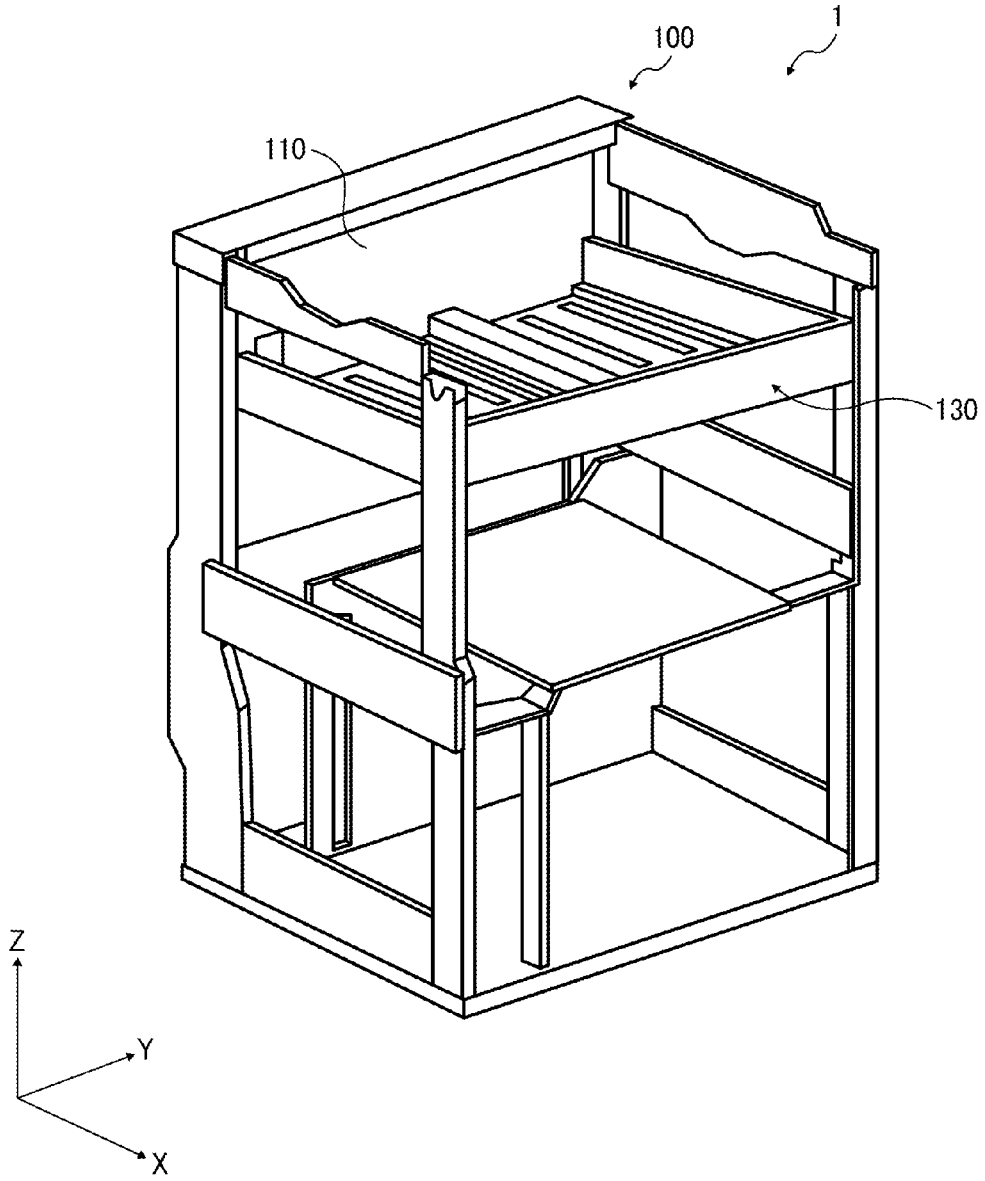
FIG. 22 is a perspective view of the frame structure in the state in which the writing device frame is fixed to the rear plate.

FIG. 22 is a perspective view of the frame structure 1 in the state in which the writing device frame 130 is fixed to the rear plate 110. The rear end of each of the support stays 135*a* and 135*b*, the partition stay 133, and the horizontal stays 132*a* and 132*b* and the rear edge of the partition plate 134 are fixed to the rear plate 110. Accordingly, the above-described structure functions also as a rear stay of the writing device frame 130, which is not provided in the present illustrative embodiment but has substantially the same functions as the front stay 131 of the writing device frame 130. Thus, provision of the rear stay to the writing device frame 130 is not needed, thereby reducing number of components and thus reducing production costs and weight of the image forming apparatus 500.

Thereafter, the positioning protrusions 131*a* formed at one end of the front stay 131 are inserted into the slots 121*a* formed in the first front post 101*a*, and the positioning protrusions 131*b* formed at the opposite end of the front stay 131 is inserted into the slots 121*b* formed in the second front post 101*b*, so that the front side of the writing device frame 130 is positioned relative to the first and second front posts 101*a* and 101*b* of the main frame 100.

Because they are not connected with each other via a stay as illustrated in FIG. 5, upper portions of the first and second front posts 101*a* and 101*b* can be slightly bent outward in the Y-axis direction, respectively. Accordingly, the positioning protrusions 131*a* and 131*b*, each protruding outward in the Y-axis direction, can be inserted into the slots 121*a* and 121*b* of the first and second front posts 101*a* and 101*b*, respectively.

Returning to FIG. 12, the writing device frame 130 extends in both the Y-axis direction and the X-axis direction and therefore tends to twist around the Y-axis direction. Consequently, if the bottom plate 103 of the main frame 100 is not level, heights of the posts 101*a*, 101*b*, 102*a*, and 102*b*, each extending upward from the bottom plate 103, are uneven, resulting in a twist in the writing device frame 130 around the Y-axis direction upon positioning of the writing device frame 130 relative to the main frame 100. When the writing device frame 130 is fixed to the main frame 100 in the state in which the writing device frame 130 is twisted in the Y-axis direction, horizontally of the support stays 135*a* and 135*b*, by which the writing units 20*a* and 20*b* are respectively supported, is lost. As a result, the writing units 20*a* and 20*b* are not accurately positioned within the image forming apparatus 500.

To prevent the twist in the writing device frame 130, it is conceivable to improve the levelness of the bottom plate 103, or to increase a thickness of the partition plate 134 so that the writing device frame 130 has improved strength. However, such a configuration may increase production costs. In addition, the weight of the image forming apparatus 500 may be increased, resulting in an increase in transportation costs of the image forming apparatus 500. By contrast, in the present illustrative embodiment, the adjustment members 140 are provided to correct the twist in the writing device frame 130 and to maintain the horizontally of the support stays 135*a* and 135*b*, on which the writing units 20*a* and 20*b* are respectively placed. As a result, the writing units 20*a* and 20*b* are accurately positioned within the image forming apparatus 500 in the horizontal direction as described in detail below.

Figure 23A:
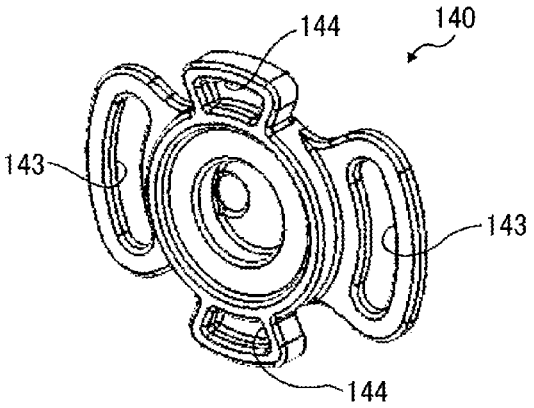
FIGS. 23A and 23B are perspective views of an adjustment member viewed from different angles, respectively.
Figure 23B:
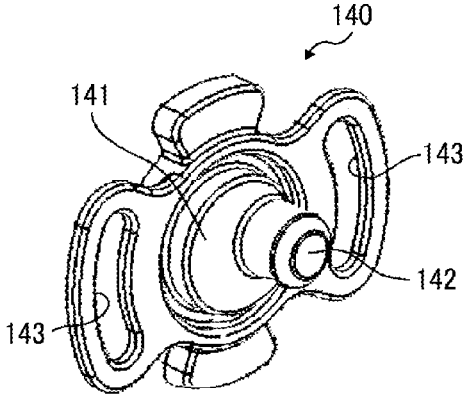

FIG. 23A is a perspective view of the adjustment member 140, and FIG. 23B is a perspective view of the adjustment member 140 viewed from a different angle from that of FIG. 23A.

Each adjustment member 140 has a fitting part 141 that fits into the mounting hole 122 formed in the first front post 101*a*. The adjustment member 140 further has the columnar support protrusion 142 provided offset from the center of the fitting part 141. Insertion holes 143, each extending along a circumferential direction of the adjustment member 140, are formed in both lateral ends of the adjustment member 140, respectively. The adjustment member 140 further includes hooks 144 provided at both top and bottom of the adjustment member 140, respectively. A tool such as a pair of needle-nose pliers is inserted in the hook 144 to rotate the adjustment member 140. It is to be noted that each adjustment member 140 is formed of resin, stainless steel, or the like.

A diameter of the fitting part 141 is substantially the same as or slightly smaller than a diameter of the mounting hole 122. A diameter of the support protrusion 142 is the same as a width of the slot-shaped support hole 131*c*.

Figure 24:
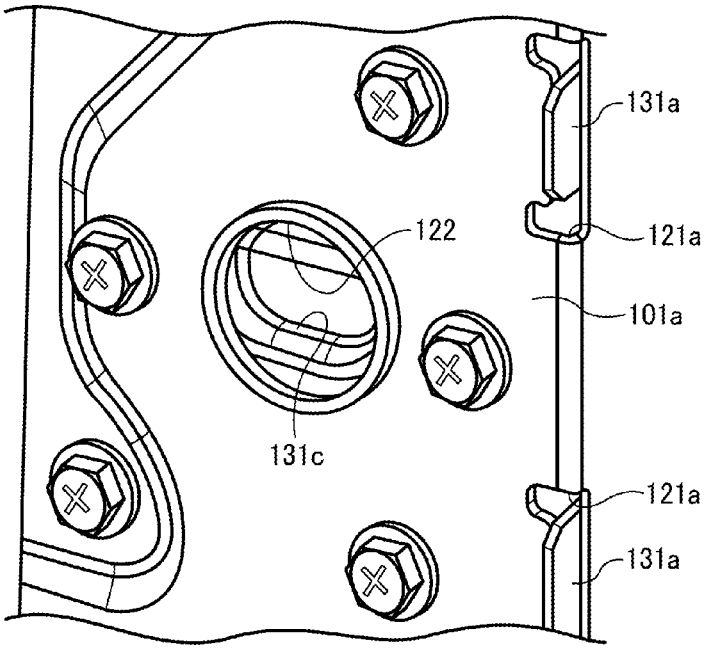
FIG. 24 is a partial enlarged view of the first front post in a state in which the writing device frame is positioned relative to the main frame.

FIG. 24 is a partial enlarged view of the first front post 101*a* around the mounting hole 122 in the state in which the writing device frame 130 is positioned relative to the main frame 100.

Figure 25:
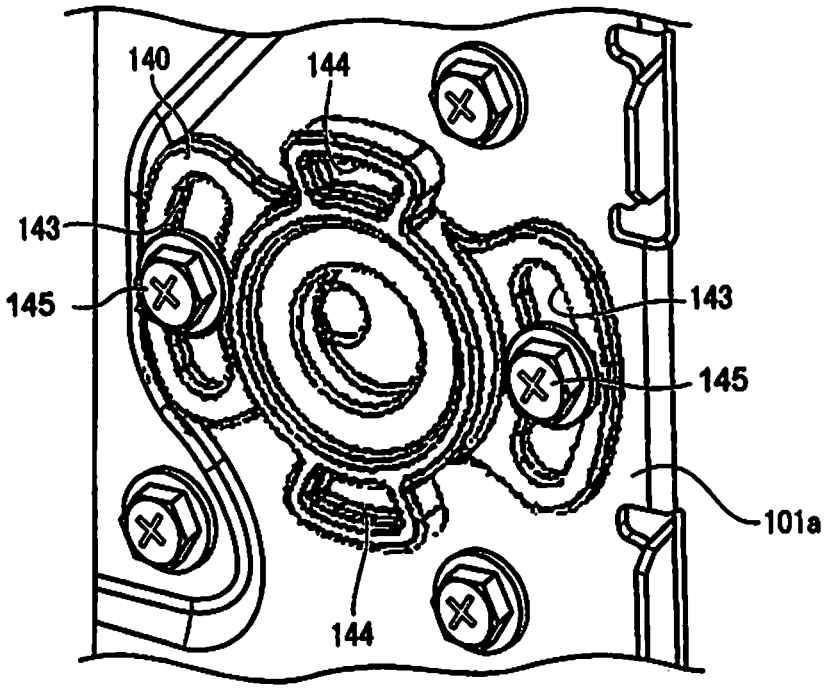
FIG. 25 is a perspective view illustrating adjustment of levelness of the writing device frame using the adjustment member.

As shown in FIG. 24, when the writing device frame 130 is positioned relative to the main frame 100, the support hole 131*c* formed in the writing device frame 130 is exposed from the mounting hole 122 of the first front post 101*a*. In such a state, the support protrusion 142 of the adjustment member 140 is inserted into the support hole 131*c* via the mounting hole 122 so that the fitting part 141 of the adjustment member 140 is fitted into the mounting hole 122. Accordingly, one front end of the writing device frame 130 in the Y-axis direction is supported by the first front post 101*a* of the main frame 100 via the support protrusion 142 of the adjustment member 140. Then, screws 145 are inserted into the insertion holes 143 of the adjustment member 140 and are fastened to the first front post 101*a*, respectively, to fix the adjustment member 140 to the first front post 101*a* as illustrated in FIG. 25.

Adjustment of levelness of the writing device frame 130 using the adjustment member 140 is described in detail below, with reference to FIG. 25.

To adjust levelness of the writing device frame 130 using the adjustment member 140, first, a level that measures a horizontally of the support stays 135*a* and 135*b*, by which the writing units 20*a* and 20*b* are supported, is set on the support stays 135*a* and 135*b*. After the screws 145 that fasten the adjustment member 140 to the first front post 101*a* are loosened, the pair of needle-nose pliers is inserted in the hook 144 to rotate the adjustment member 140. When the adjustment member 140 is rotated, the support protrusion 142 is rotated within the slot-shaped support hole 131*c* so that the front end of the writing device frame 130 in the Y-axis direction is displaced in the vertical direction, that is, the Z-axis direction. While the horizontally of the support stays 135*a* and 135*b* are being confirmed using the level, the adjustment member 140 is further rotated until the support stays 135*a* and 135*b* become horizontal. Then, rotation of the adjustment member 140 is stopped and the adjustment member 140 is fastened to the first front post 101*a* with the screws 145 again. Thus, rotation of the adjustment member 140 is prevented even when an impact is applied to the image forming apparatus 500 after the adjustment of horizontally of the support stays 135*a* and 135*b*, thereby maintaining the levelness of the writing device frame 130 over time.

As described previously, the vertical length of each slot 121*a* of the first front post 101*a* is longer than the vertical length of each positioning protrusion 131*a* provided to the front stay 131 of the writing device frame 130. Therefore, when the positioning protrusions 131*a* are inserted into the slots 121*a*, respectively, there is a gap in the vertical direction between each positioning protrusion 131*a* and each slot 121*a*. Accordingly, the front end of the writing device frame 130 in the Y-axis direction is displaced in the vertical direction, that is, the Z-axis direction, using the adjustment member 140 without the slots 121*a* being hit by the positioning protrusions 131*a*, respectively.

Next, the writing device frame 130 is fixed to the first and second front post 101*a* and 101*b* with screws, respectively, from the X-axis direction. As a result, the writing device frame 130 is sandwiched by and fixed to the rear plate 110 and the first and second front posts 101*a* and 101*b* in the X-axis direction, thereby preventing the writing device frame 130 from vibrating against the main frame 100 in the X-axis direction. Further, the writing device frame 130 is fixed to the first and second front posts 101*a* and 101*b* in the Y-axis direction with screws, and is also fixed to the first and second rear posts 120*a* and 120*b* in the Y-axis direction with screws. As a result, even when an impact is applied to the image forming apparatus 500 in the Y-axis direction, the writing device frame 130 is prevented from vibrating in the Y-axis direction.

After fixing of the writing device frame 130 to the main frame 100, photoconductor shafts of the photoconductors 41 included in the process cartridges 40 are inserted into the rear positioning holes 111Y, 111M, 111C, and 111K formed in the rear plate 110, respectively, to position the process cartridges 40 relative to the rear plate 110. In addition, rear protrusions of the transfer device 10, not shown, are inserted into the rear positioning holes 112 formed in the rear plate 110, respectively, to position the transfer device 10 relative to the rear plate 110.

Figure 26:
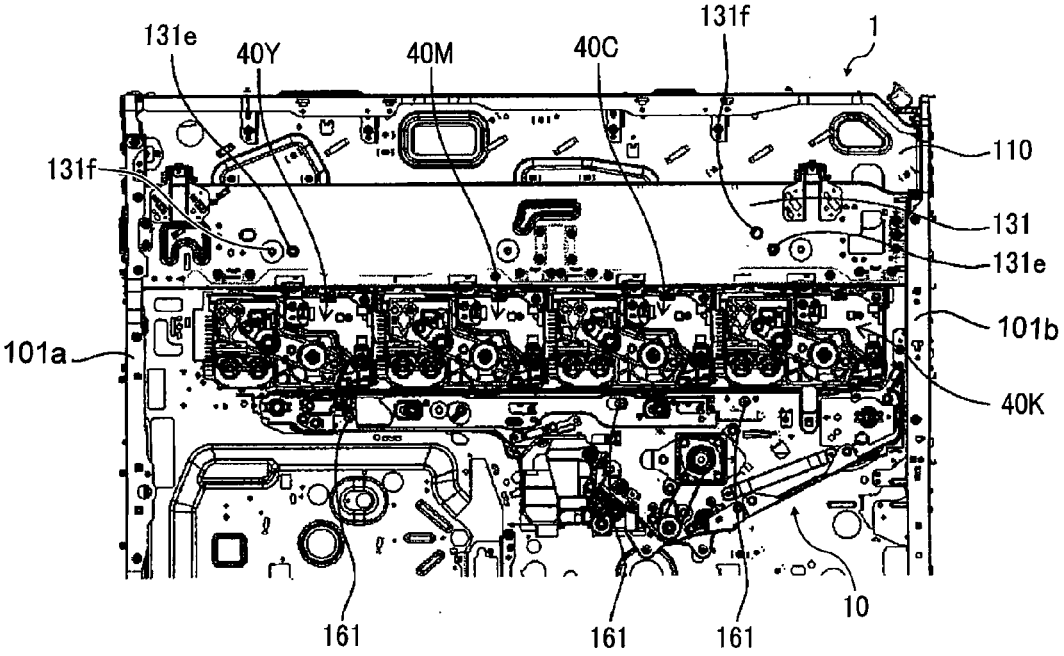
FIG. 26 is a vertical cross-sectional view illustrating a state in which process cartridges and a transfer device are fixed to the rear plate.
Figure 27:
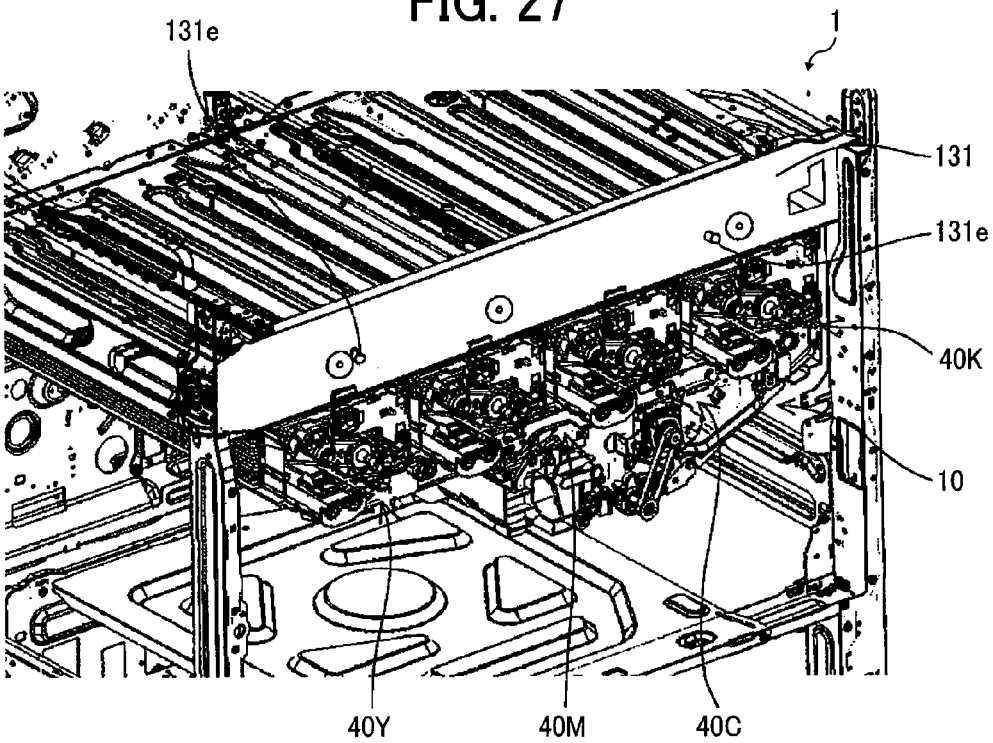
FIG. 27 is a perspective view of the state illustrated in FIG. 26.

FIG. 26 is a vertical cross-sectional view illustrating a state in which the process cartridges 40 and the transfer device 10 are fixed to the rear plate 110. FIG. 27 is a perspective view of the state illustrated in FIG. 26.

The front stay 131 of the writing device frame 130 has front positioning protrusions 131*e* provided at two separate positions at a predetermined interval in the Y-axis direction. The front positioning protrusions 131*e* position a front plate 150 relative to the writing device frame 130. In addition, screw holes 131*f*, to which the front plate 150 is fastened with screws, are formed in the front stay 131 at two separate positions. The transfer device 10 has front positioning protrusions 161 on the front side of the transfer device 10 at three separate positions.

Figure 28:
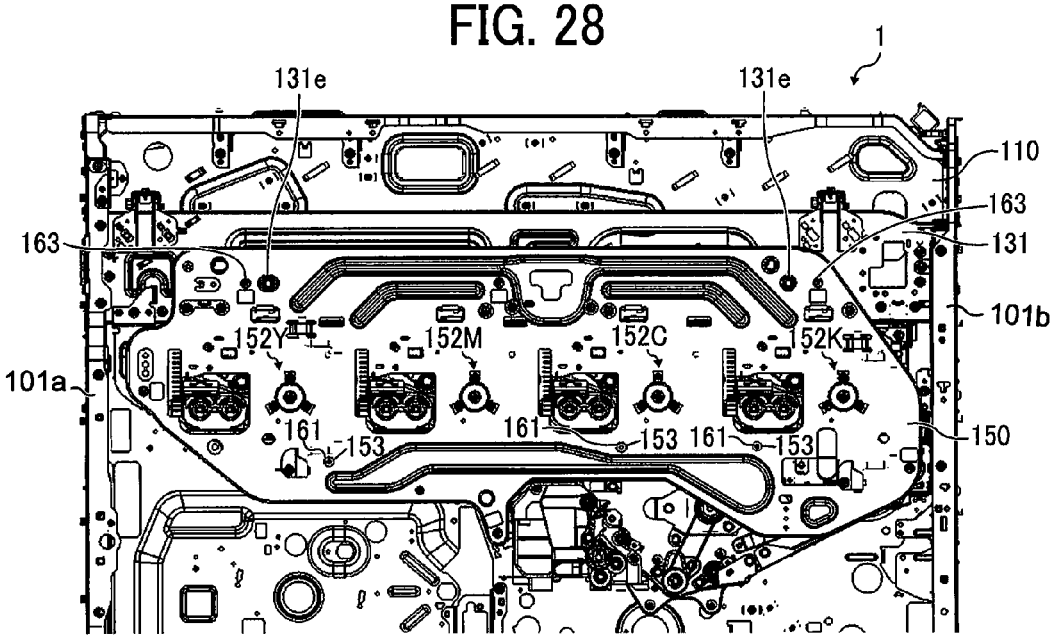
FIG. 28 is a vertical cross-sectional view illustrating a state in which a front plate is fixed to the writing device frame.
Figure 29:
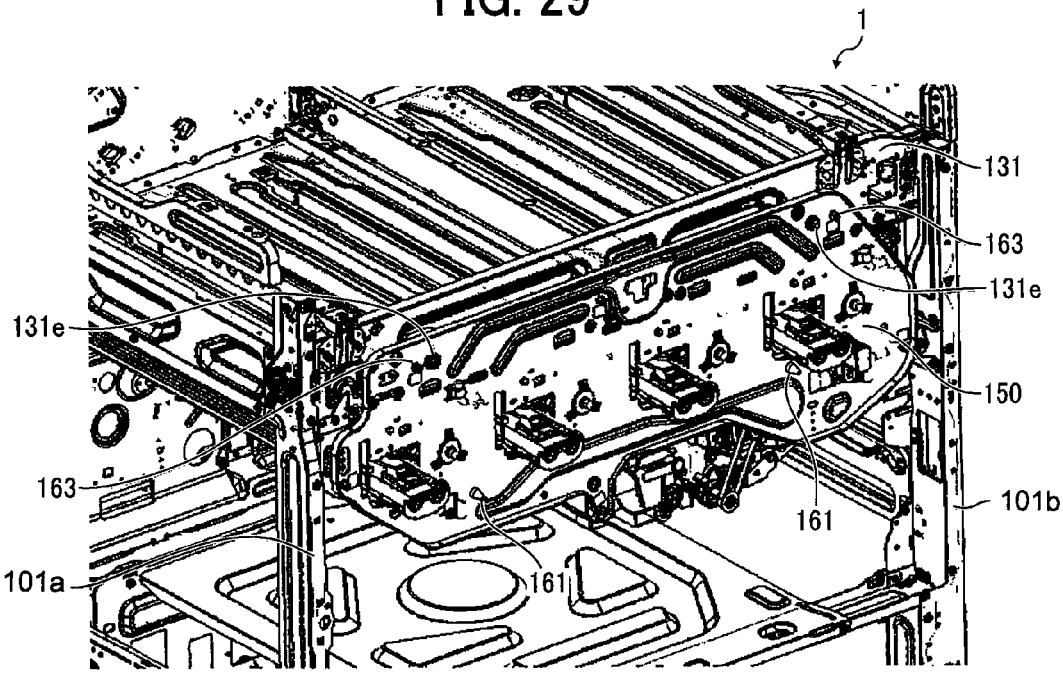
FIG. 29 is a perspective view of the state illustrated in FIG. 28.

FIG. 28 is a vertical cross-sectional view illustrating a state in which the front plate 150 is fixed to the writing device frame 130. FIG. 29 is a perspective view of the state illustrated in FIG. 28.

Front positioning holes 152Y, 152M, 152C, and 152K, into which front shafts of the photoconductors 41 are inserted, respectively, are formed in the front plate 150. The front plate 150 further has front positioning holes 153 at three separate positions, into which the front positioning protrusions 161 of the transfer device 10 are inserted. The front shafts of the photoconductors 41 are inserted into the front positioning holes 152Y, 152M, 152C. 152K, respectively, so that the photoconductors 41 are positioned within the image forming apparatus 500. Thus, the process cartridges 40 each including the corresponding photoconductor 41 are positioned within the image forming apparatus 500 by both the front plate 150 and the rear plate 110. The front positioning protrusions 161 of the transfer device 10 are inserted into the front positioning holes 153 formed in the front plate 150, respectively. As a result, the transfer device 10 is positioned relative to both the front plate 150 and the rear plate 110. After the process cartridges 40 and the transfer device 10 are positioned relative to the front plate 150 and the rear plate 110, the front plate 150 is fastened to the front stay 131 of the writing device frame 130 with screws 163.

In the present illustrative embodiment, the writing device frame 130 is directly fixed to the rear plate 110 without the main frame 100 interposed therebetween, thereby eliminating accumulation of tolerances of the main frame 100 compared to a configuration in which the rear plate 110 and the writing device frame 130 are individually fixed to the main frame 100. Accordingly, the writing device frame 130 and the rear plate 110 are accurately positioned relative to each other. In addition, the front plate 150 is directly fixed to the writing device frame 130 without the main frame 100 interposed therebetween, thereby eliminating accumulation of tolerances of the main frame 100 compared to a configuration in which the front plate 150 and the writing device frame 130 are individually fixed to the main frame 100. Accordingly, the writing device frame 130 and the front plate 150 are accurately positioned relative to each other. As a result, inequality of the distance between the writing units 20*a* and 20*b*, both of which are fixed to the writing device frame 130, and the photoconductors 41, each of which are fixed to the rear plate 110 and the front plate 150, is prevented, thereby preventing color shifts in resultant images. In addition, because the photoconductors 41 are positioned by both the front plate 150 and the rear plate 110, inequality of the distance between the photoconductors 41 is also prevented. Further, the transfer device 10 is positioned by both the front plate 150 and the rear plate 110, each of which is used for positioning the photoconductors 41. As a result, inequality of the distance between the photoconductors 41 and the intermediate transfer belt 11 is also prevented.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A frame structure for use in an image forming apparatus, comprising:

a main frame having multiple posts;

a front plate to position a first end of a latent image carrier within the image forming apparatus;

a rear plate fixed to the main frame to position a second end of the latent image carrier opposite the first end within the image forming apparatus;

a writing device frame fixed to the rear plate and connected to at least two posts of the multiple posts to position a latent image writing unit that writes a latent image onto the latent image carrier within the image forming apparatus, the front plate being fixed to the writing device frame; and an adjustment member to adjust levelness of the writing device frame onto which the latent image writing unit is installed, wherein the front plate is fixed to the writing device frame without fixing to the at least two posts, wherein the rear plate is fixed to the main frame at least at three separate positions, at least one position being offset from a hypothetical line connecting the other two positions.

2. The frame structure according to claim 1, wherein the writing device frame comprises a support stay extending in an axial direction of the latent image carrier to support the latent image writing unit, one end of the support stay being supported by the rear plate.

3. The frame structure according to claim 1, wherein the adjustment member is fixed to the main frame after the adjustment of the levelness of the writing device frame.

4. The frame structure according to claim 1, wherein the adjustment member adjusts a position of one end of a front side of the writing device frame relative to the main frame in a vertical direction.

5. The frame structure according to claim 1, wherein multiple latent image carriers and a transfer device that sequentially transfers images from the multiple latent image carriers onto a transfer body included in the transfer device are positioned within the image forming apparatus by the front plate and the rear plate.

6. An image forming apparatus, comprising:

a latent image carrier;

a latent image writing unit to write a latent image onto the latent image carrier;

a developing device to develop the latent image formed on the latent image carrier with developer to form a visual image on the latent image carrier;

a transfer device to transfer the visual image from the latent image carrier onto a recording medium; and a frame structure for use in the image forming apparatus, comprising:

a main frame having multiple posts;

a front plate to position a first end of the latent image carrier within the image forming apparatus;

a rear plate fixed to the main frame to position a second end of the latent image carrier opposite the first end within the image forming apparatus;

a writing device frame fixed to the rear plate and connected to at least two posts of the multiple posts to position the latent image writing unit within the image forming apparatus, the front plate being fixed to the writing device frame; and an adjustment member to adjust levelness of the writing device frame onto which the latent image writing unit is installed, wherein the rear plate is fixed to the main frame at least at three separate positions, at least one position being offset from a hypothetical line connecting the other two positions, wherein the front plate is fixed to the writing device frame without fixing to the at least two posts.

7. A frame structure for use in an image forming apparatus, comprising:

a main frame having multiple posts;

a front plate to position a first end of a latent image carrier within the image forming apparatus;

a rear plate fixed to the main frame to position a second end of the latent image carrier opposite the first end within the image forming apparatus;

a writing device frame fixed to the rear plate and connected to at least two posts of the multiple posts to position a latent image writing unit that writes a latent image onto the latent image carrier within the image forming apparatus, the front plate being fixed to the writing device frame; and an adjustment member to adjust levelness of the writing device frame onto which the latent image writing unit is installed, wherein the front plate is fixed to the writing device frame without fixing to the at least two posts, wherein the rear plate is fixed to the main frame at least at three separate positions, at least one position being offset from a hypothetical line connecting the other two positions, the adjustment member includes a support protrusion, and the adjustment member rotates about the support protrusion to adjust the level of the writing device frame.

* * * * *